US007095166B2

(12) United States Patent
Jung

(10) Patent No.: US 7,095,166 B2
(45) Date of Patent: Aug. 22, 2006

(54) CATHODE RAY TUBE WITH IMPROVED THICKNESS PROFILE

(75) Inventor: Won Ho Jung, Gumi-si (KR)

(73) Assignee: LG Philips Displays Korea Co., Ltd., Gumi-Si (KR)

( * ) Notice: Subject to any disclaimer, the term of this patent is extended or adjusted under 35 U.S.C. 154(b) by 0 days.

(21) Appl. No.: 10/878,116

(22) Filed: Jun. 29, 2004

(65) Prior Publication Data

US 2005/0023954 A1 Feb. 3, 2005

(30) Foreign Application Priority Data

Jun. 30, 2003 (KR) ..... 10-2003-0043287

(51) Int. Cl.
*H01J 31/00* (2006.01)

(52) U.S. Cl. ..... 313/477 R; 220/2.1 A

(58) Field of Classification Search ..... 313/477 R, 313/461, 361, 365; 220/2.1 A, 2.3 A
See application file for complete search history.

(56) References Cited

U.S. PATENT DOCUMENTS 6,259,206 B1 * 7/2001 Tsuchiya et al. ..... 315/3
6,693,374 B1 * 2/2004 Tho et al. ..... 313/477 R
2002/0014820 A1 * 2/2002 Jung ..... 313/402
2003/0168963 A1 * 9/2003 Baek ..... 313/477 R

* cited by examiner

*Primary Examiner*—Ashok Patel
(74) *Attorney, Agent, or Firm*—Birch, Stewart, Kolasch & Birch, LLP

(57) ABSTRACT

Disclosed is a cathode ray tube, comprising a panel of which outer surface is substantially flat and inner surface has a designated radius of curvature, a funnel connected to the panel, an electron gun housed in the funnel, emitting electron beams, a deflection yoke for deflecting the electron beams, and a shadow mask for discriminating the electron beams in colors, wherein a ratio (%) of a corner portion of the panel to a thickness at a central portion of the panel is in a range of 150%~230%, and design sizes of the panel satisfy a relation of $$CFT \times \frac{USD}{IBRD} \times 100 \leq 1100\,\text{mm}$$

(wherein, CFT denotes a thickness at the central portion of the panel, USD denotes a diagonal length of an effective surface of the panel, and IBRD denotes 2×a distance from the center of the panel to the center of a radius of curvature from the corner portion of the panel).

10 Claims, 5 Drawing Sheets

CATHODE RAY TUBE WITH IMPROVED THICKNESS PROFILE

BACKGROUND OF THE INVENTION

This Non-provisional application claims priority under 35 U.S.C. § 119(a) on patent application No(s). 10-2003-0043287 filed in Korea on Jun. 30, 2003, the entire contents of which are hereby incorporated by reference.

1. Field of the Invention

The present invention relates to a cathode ray tube, more particularly, to a cathode ray tube an improved panel structure, in which the thickness of a panel is reduced to an appropriate level, resulting in minimization of cost of manufacture and panel damages during a manufacture process, and improved brightness.

2. Discussion of the Background Art

FIG. 1 illustrates the structure of a related art cathode ray tube.

Referring to FIG. 1, the cathode ray tube includes a panel 1 having a fluorescent screen 4 formed on an inner surface thereof, a funnel 2 connected to the panel 1, an electron gun 8 housed in the funnel 2, emitting electrons, a deflection yoke 9 for deflecting the electron beams in horizontal and vertical directions, a shadow mask 3 with a color selecting function of the electron beams 11, a mask frame 5 for supporting the shadow mask 3, and an inner shield 7 for shielding the influence of a geomagnetic field on the operation of the cathode ray tube.

As to the operation of the related art cathode ray tube with the above structure, the electron beams 11 emitted from the electron gun 8 housed in the funnel 2 are deflected by the deflection yoke 9, and collided with the fluorescent screen formed on the inner surface of the panel 1, displaying a desired image.

FIG. 2 and FIG. 3 illustrate a panel for use in the related art cathode ray tube.

For example, FIG. 2 illustrates a panel 1 whose inner and outer surfaces have designated radii of curvature, and FIG. 3 illustrates a panel 10 whose outer surface is substantially flat while inner surface has a designated radius of curvature.

FIG. 4 is a comparative view of panels illustrated in FIGS. 2 and 3. From the center, the left side shows the panel 10 of FIG. 3 of which outer surface is substantially flat and inner surface has a designated radius of curvature, and the right side shows the panel 1 of FIG. 2 of which inner and outer surfaces have designated radii of curvature.

In recent years, the panel 10 of FIG. 3 having the substantially flat surface has been a mainstream of cathode ray tubes mainly because when the outer surface is flat, image distortions occur much less and there is little reflection from an external light, overall providing a high quality picture image.

Referring to FIG. 4, it is noticed that the panel 10 of FIG. 3 has a greater OMH (a distance from a mold match line to a seal edge line) than that of the panel 1 whose inner and outer surfaces are both curved at designated curvatures.

Because of the above, a total thickness of the panel 10 having the substantially flat outer surface is increased, and thus, a total weight thereof is naturally increased as well.

Besides, a maximum thickness of an end portion 6 between a skirt portion of the panel and an effective surface of the panel is increased, and this in turn causes a difference in thermal conductivity inside a furnace. As a result thereof, the glass of the panel is damaged.

In addition, compared to the panel 1 having curved inner and outer surfaces at designated radii of curvature, the panel 10 with the substantially flat outer surface exhibits a structural weakness especially related to implosion-proof properties. To complement such weakness, manufacturers made the panel 10 thicker. However, this only degraded brightness of the screen.

Therefore, as the thickness of the panel 10 having the substantially flat outer surface is increased, damages are more likely to be made on the glass, and material cost and manufacturing cost are increased.

SUMMARY OF THE INVENTION

An object of the invention is to solve at least the above problems and/or disadvantages and to provide at least the advantages described hereinafter.

Accordingly, one object of the present invention is to solve the foregoing problems by providing a cathode ray tube an improved panel structure, in which the thickness of a panel is reduced to an appropriate level, resulting in minimization of cost of manufacture and panel damages during a manufacture process, and improved brightness.

The foregoing and other objects and advantages are realized by providing a cathode ray tube, comprising a panel of which outer surface is substantially flat and inner surface has a designated radius of curvature, a funnel connected to the panel, an electron gun housed in the funnel, emitting electron beams, a deflection yoke for deflecting the electron beams, and a shadow mask for discriminating the electron beams in colors, wherein a ratio (%) of a thickness at a corner portion of the panel to a central portion of the panel is in a range of 150%~230%, and design sizes of the panel satisfy a relation of $$CFT \times \frac{USD}{IBRD} \times 100 \leq 1100 \text{ mm}$$

(wherein, CFT denotes a thickness at the central portion of the panel, USD denotes a diagonal length of an effective surface of the panel, and IBRD denotes 2×a distance from the center of the panel to the center of a radius of curvature from the corner portion of the panel).

In an exemplary embodiment, the design sizes of the panel satisfy a relation of $$750 \text{ mm} \leq CFT \times \frac{USD}{IBRD} \times 100 \leq 1100 \text{ mm}.$$

In an exemplary embodiment, the panel satisfies a condition of $$99\% \leq \frac{IBRD}{USD} \times 100\%.$$

In an exemplary embodiment, the panel satisfies a condition of $$99\% \leq \frac{IBRD}{USD} \times 100\% \leq 102.5\%.$$

In an exemplary embodiment, the panel satisfies a condition of 5.8 mm≦R.

In an exemplary embodiment, the panel satisfies a condition of 5.8 mm ≦R≦10.0 mm.

In an exemplary embodiment, the radius of curvature of the inner surface of the panel in a diagonal direction is in a range of 1000 mm–2000 mm.

In an exemplary embodiment, a radius of curvature of the outer surface of the panel in a diagonal direction is 3000 mm or more.

In an exemplary embodiment, the diagonal length of the effective surface of the panel is 500 mm or less.

In an exemplary embodiment, the cathode ray tube is for use in a computer monitor.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a cathode ray tube according to a preferred embodiment of the invention in reference to the accompanying drawings.

The cathode ray tube according to the present invention includes a panel having a fluorescent screen formed on an inner surface thereof, a funnel connected to the panel, an electron gun housed in the funnel, emitting electrons, a deflection yoke for deflecting the electron beams in horizontal and vertical directions, and a shadow mask with a color selecting function of the electron beams.

The panel has a substantially flat outer surface and a curved inner surface at a designated radius of curvature.

Figure 1:
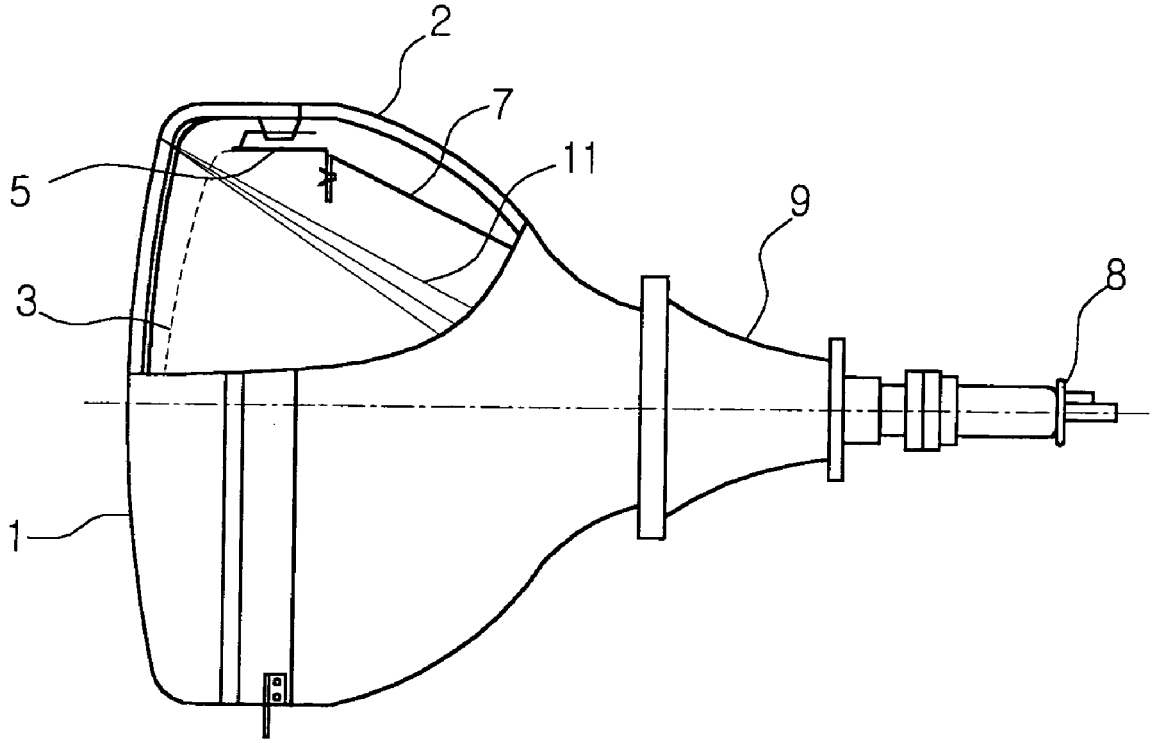
Fig.1 Related Art
FIG. 1 illustrates the structure of a related art cathode ray tube.
Figure 2:
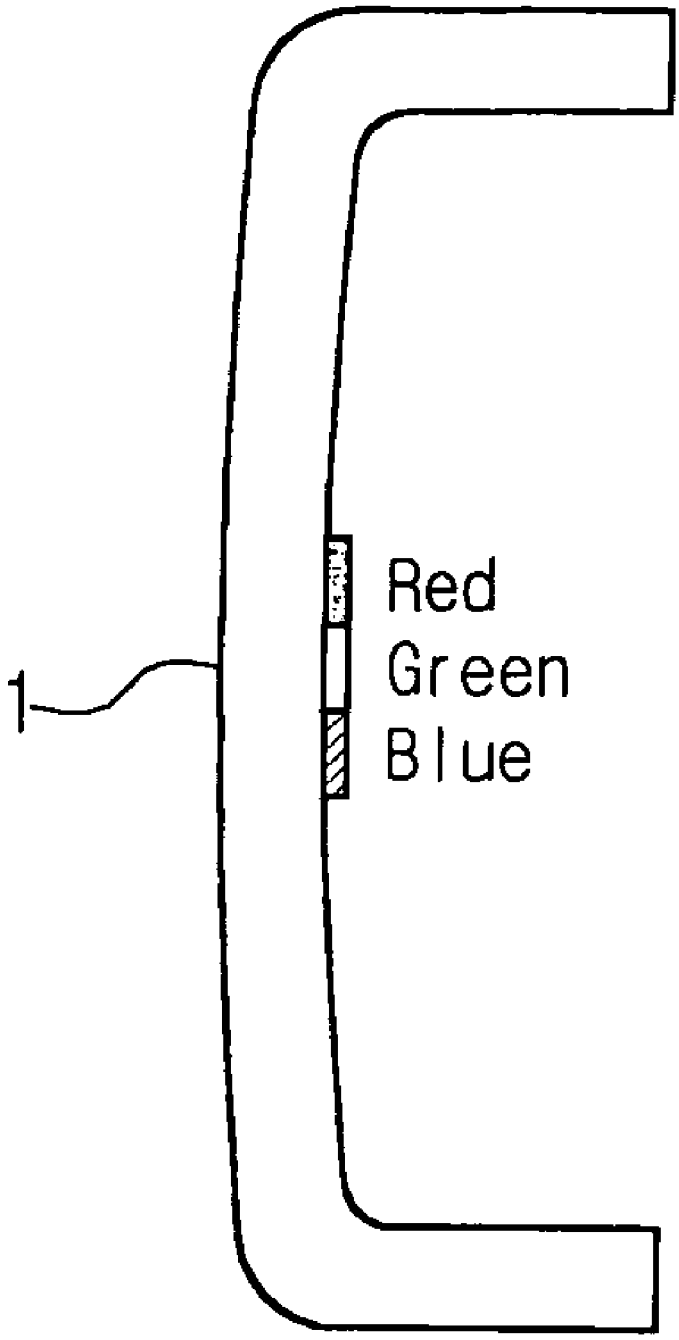
Fig.2 Related Art
FIG. 2 illustrates a related art panel whose inner and outer surfaces have designated radii of curvature.
Figure 3:
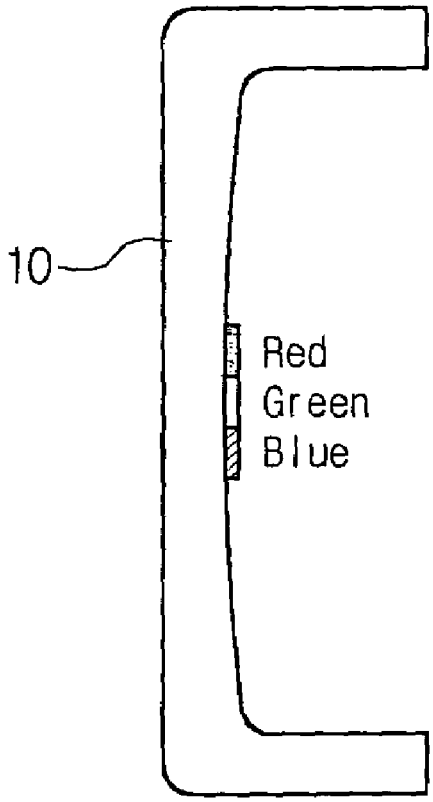
Fig.3 Related Art
FIG. 3 illustrates a related art panel whose outer surface is substantially flat and inner surface has a designated radius of curvature.
Figure 4:
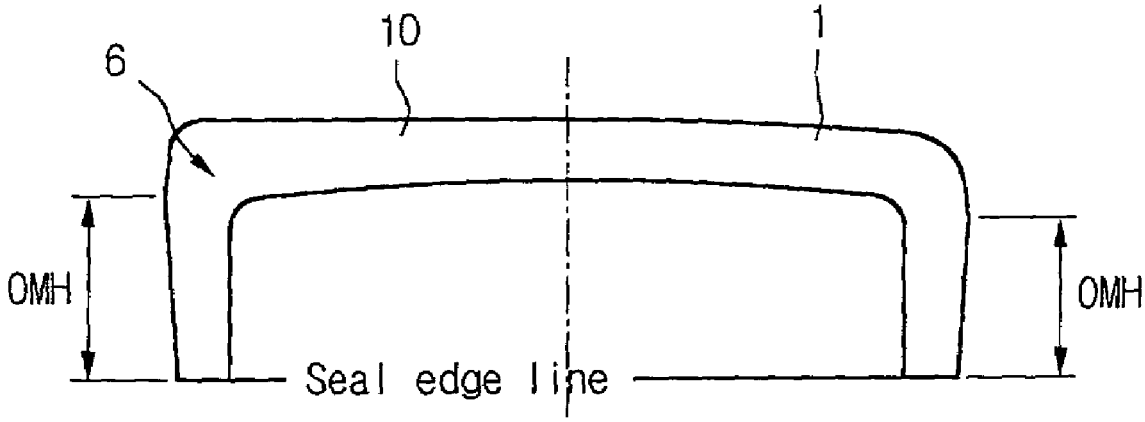
Fig.4 Related Art
FIG. 4 is a comparative view of a panel of FIG. 3, of which outer surface is substantially flat and inner surface has a designated radius of curvature, and a panel of FIG. 2, of which inner and outer surfaces have designated radii of curvature.
Figure 5:
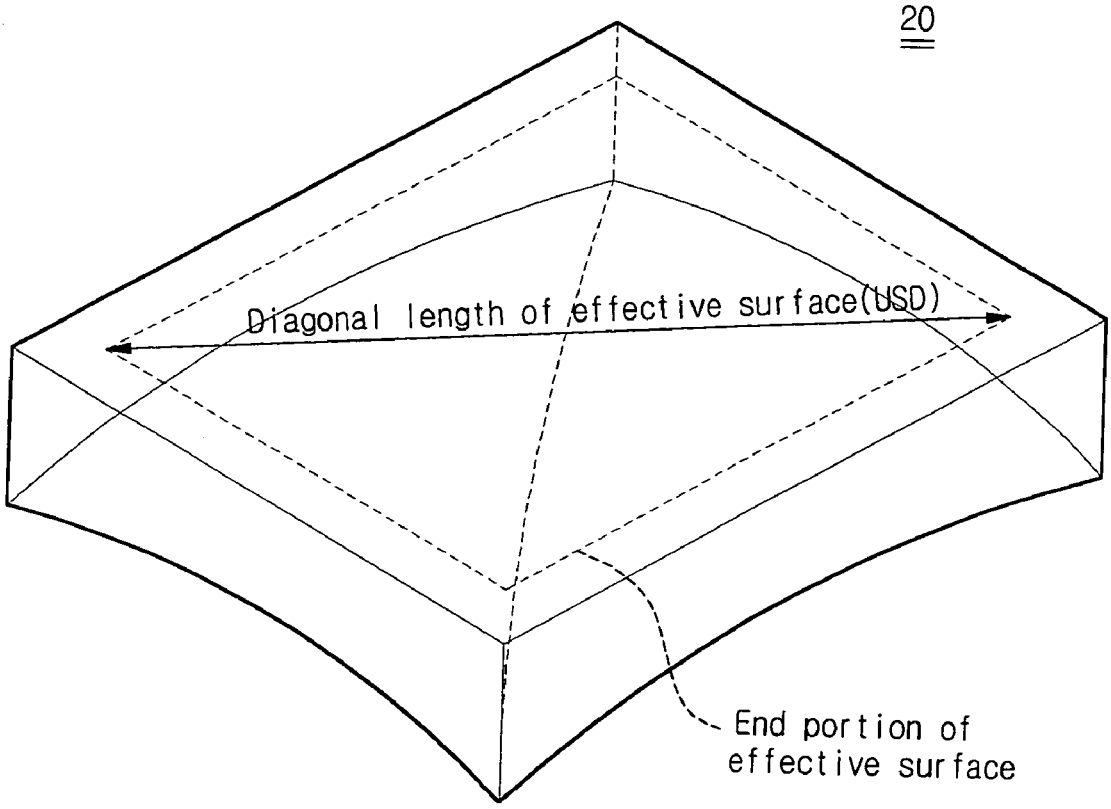
FIG. 5 illustrates a panel in accordance with a preferred embodiment of the present invention.

FIG. 5 illustrates the panel in accordance with a preferred embodiment of the invention.

In FIG. 5, a radius of curvature of the inner surface of the panel 20 in the diagonal direction is in a range of 1000 mm–2000 mm, and a radius of curvature of the outer surface of the panel 20 in the diagonal direction is 3000 mm or more.

The cathode ray tube of the invention is applicable to computer monitors. A diagonal length of an effective surface (USD) of the panel 20 is 500 mm or less, and a ratio (in %) of a thickness of a diagonal corner portion of the panel 20 to a thickness at a central portion of the panel 20 (this ratio is called as a 'wedge rate') is in a range of 150%–230%.

Figure 6:
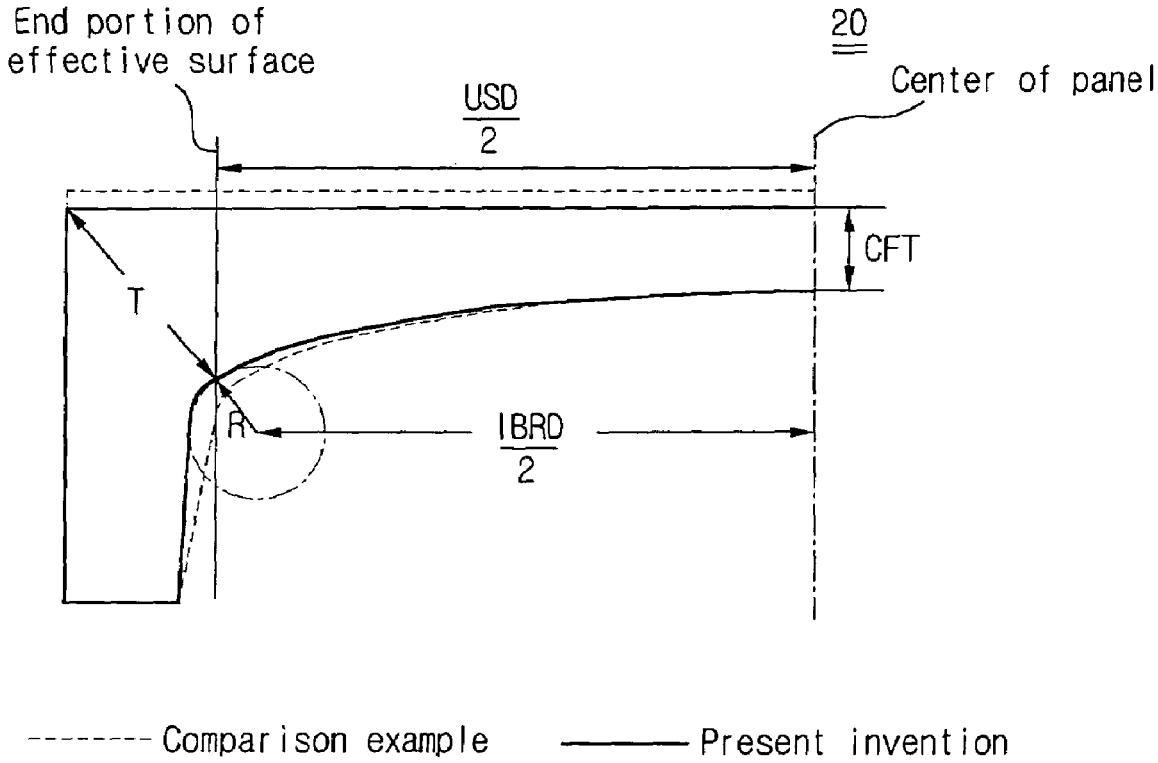
FIG. 6 is a cross-sectional view of a panel in accordance with the preferred embodiment of the present invention.

FIG. 6 illustrates a panel whose outer surface is substantially flat and inner surface has a designated radius of curvature. The panel of the invention is indicated by the solid line, and a comparison example is indicated by the dotted line.

To give a brief description on the difference between two panels of FIG. 6, it is noticed from the drawing that the panel of the invention has a reduced thickness at the central portion of the panel (CFT), and a reduced maximum thickness (T) between a skirt portion of the panel and an end portion of an effective surface of the panel.

More details on FIG. 6 will now be provided below.

In FIG. 6, CFT denotes a thickness at the central portion of the panel, USD denotes a diagonal length of the effective surface of the panel, T denotes a maximum thickness between the skirt portion of the panel and the end portion of the effective surface of the panel, and R denotes a radius of curvature of the end portion of the effective surface of the panel of the corner portion of the panel.

Also, IBRD is two times a distance from the center of the panel to the center of the radius of curvature of the corner portion of the panel.

Meanwhile, when electron beams emitted from the electron gun strike the fluorescent screen, X-rays are usually produced and the X-rays penetrate the panel and are emitted from the panel. Although the amount of X-ray being produced is so small that it is insignificant, its upper limit has been set for the safety of users.

To satisfy the standard for the X-ray, it is important that the values of CFT, USD, and IBRD satisfy designated ranges.

Therefore, the panel should be carefully designed in consideration with the above. The present invention suggests the following equation to satisfy the standard.

$$750\ \text{mm} \le CFT \times \frac{USD}{IBRD} \times 100 \le 1100\ \text{mm}$$

When the $$CFT \times \frac{USD}{IBRD} \times 100$$

is less than 750 mm, the standard for restricting X-ray amount cannot be satisfied. On the other hand, when the $$CFT \times \frac{USD}{IBRD} \times 100$$

is greater than 1100 mm, the sense of flatness of the screen is degraded, and glass is easily damaged by the thickness difference between the central portion of the panel and the peripheral portion of the panel.

Moreover, the USD and the IBRD values are to satisfy the following ranges.

$$99\% \leq \frac{IBRD}{USD} \times 100\% \leq 102.5\%$$

When the $$\frac{IBRD}{USD} \times 100\%$$

is less than 99%, the maximum thickness T between the skirt portion of the panel and the end portion of the effective surface of the panel gets so great that glass damage is increased. Meanwhile, when the $$\frac{IBRD}{USD} \times 100\%$$

is greater than 102.5%, the maximum thickness T between the skirt portion of the panel and the end portion of the effective surface of the panel gets so small that tension is concentrated thereon and this results in deterioration of implosion-proof properties.

The R, which is the radius of curvature of the end portion of the effective surface of the panel of the corner portion of the panel is designed to satisfy the following condition.

5.8 mm≦R≦10.0 mm.

When the R is less than 5.8 mm, it is not easy to manufacture the glass, and when the R is greater than 10.0 mm, implosion-proof properties are deteriorated because of the concentrated tension.

Table 1 below shows design sizes for the panel of the present invention and for the panel of the comparison example.

TABLE 1

| | 17-inch cathode ray tube | | 19-inch cathode ray tube | |
|---|---|---|---|---|
| | Comparison Example | Present Invention | Comparison Example | Present Invention |
| CFT | 11.0 mm | 8.5 mm | 11.5 mm | 8.5 mm |
| IBRD | 201.0 mm | 201.6 mm | 227.9 mm | 229.0 mm |
| USD | 203.2 mm | 203.2 mm | 228.6 mm | 228.6 mm |
| T | 26.1 mm | 24.7 mm | 27.4 mm | 25.8 mm |
| R | 5.5 mm | 7.0 mm | 5.5 mm | 6.0 mm |
| $CFT \times \frac{USD}{IBRD} \times 100$ | 1112 mm | 843 mm | 1154 mm | 930 mm |

As shown in the above Table 1, under the same diagonal size of the effective surface (USD), the panel of the present invention has a reduced thickness at the central portion of the panel (CFT), a reduced maximum thickness (T) between the skirt portion of the panel and the end portion of the effective surface of the panel, and an enlarged radius of curvature of the end portion of the effective surface of the panel of the corner portion of the panel(R).

Therefore, by reducing the thickness of the related art panel, brightness has been improved, and panel damage during the thermal treatment process has been minimized. Also, as the thickness of the panel is reduced, cost of manufacture can also be cut down.

By minimizing panel damage during the manufacturing process of the panel, yield can be increased and cost of manufacture of the panel can be reduced.

Also, by reducing the thickness of the panel, the brightness of the screen can be improved.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube, comprising a panel of which outer surface is substantially flat and inner surface has a designated radius of curvature, a funnel connected to the panel, an electron gun housed in the funnel, emitting electron beams, a deflection yoke for deflecting the electron beams, and a shadow mask for discriminating the electron beams in colors, wherein a ratio (%) of a thickness at a corner portion of the panel to a central portion of the panel is in a range of 150%~230%, and design sizes of the panel satisfy a relation of $$CFT \times \frac{USD}{IBRD} \times 100 \leq 1100 \text{ mm}$$

wherein CFT denotes a thickness at the central portion of the panel, USD denotes a diagonal length of an effective surface of the panel, and IBRD denotes 2×a distance from the center of the panel to the center of a radius of curvature from the corner portion of the panel.

2. The cathode ray tube according to claim 1, wherein the design sizes of the panel satisfy a relation of $$750 \text{ mm} \leq CFT \times \frac{USD}{IBRD} \times 100 \leq 1100 \text{ mm}$$

wherein CFT denotes a thickness at the central portion of the panel, USD denotes a diagonal length of an effective surface of the panel, and IBRD denotes 2×a distance from the center of the panel to the center of a radius of curvature from the corner portion of the panel.

3. The cathode ray tube according to claim 1, wherein the panel satisfies a condition of $$99\% \leq \frac{IBRD}{USD} \times 100\%$$

wherein USD denotes a diagonal length of an effective surface of the panel, and IBRD denotes 2×a distance from the center of the panel to the center of a radius of curvature from the corner portion of the panel.

4. The cathode ray tube according to claim 1, wherein the panel satisfies a condition of $$99\% \leq \frac{IBRD}{USD} \times 100\% \leq 102.5\%$$

wherein USD denotes a diagonal length of an effective surface of the panel, and IBRD denotes 2×a distance from the center of the panel to the center of a radius of curvature from the corner portion of the panel.

5. The cathode ray tube according to claim 1, wherein the panel satisfies a condition of 5.8 mm≦R wherein R denotes a radius of curvature of the end portion of the effective surface of the panel of the corner portion of the panel.

6. The cathode ray tube according to claim 1, wherein the panel satisfies a condition of 5.8 mm≦R≦10.0 mm wherein R denotes a radius of curvature of the end portion of the effective surface of the panel of the corner portion of the panel.

7. The cathode ray tube according to claim 1, wherein a radius of curvature of the inner surface of the panel in a diagonal direction is in a range of 1000 mm –2000 mm.

8. The cathode ray tube according to claim 1, wherein a radius of curvature of the outer surface of the panel in a diagonal direction is 3000 mm or more.

9. The cathode ray tube according to claim 1, wherein the diagonal length of the effective surface of the panel is 500 mm or less.

10. The cathode ray tube according to claim 1, wherein the cathode ray tube is for use in a computer monitor.

* * * * *